US005585579A

United States Patent [19]

Ignatius

[11] Patent Number: 5,585,579

[45] Date of Patent: Dec. 17, 1996

[54] SOLID BODY CAPABLE OF VIBRATION AND/OR REFLECTION IN DEVICES AND INSTALLATIONS FOR GENERATING, RADIATING, DISTRIBUTING OR TRANSMITTING SOUND VIBRATIONS

[76] Inventor: Georg Ignatius, D-7841 Malsburg, Hoefe 58, Germany

[21] Appl. No.: 207,807

[22] Filed: Mar. 8, 1994

Related U.S. Application Data

[63] Continuation of Ser. No. 117,543, Sep. 3, 1993, abandoned, which is a continuation of Ser. No. 573,280, Aug. 24, 1990, abandoned, which is a continuation of Ser. No. 399,369, Aug. 24, 1989, abandoned, which is a continuation of Ser. No. 277,514, Nov. 21, 1988, abandoned, which is a continuation of Ser. No. 37,051, Apr. 13, 1987, abandoned, which is a continuation of Ser. No. 631,638, Jul. 17, 1984, abandoned.

[30] Foreign Application Priority Data

Jul. 19, 1983 [DE] Germany ..... 33 26 006.0

[51] Int. Cl.[6] ..... G10D 1/00

[52] U.S. Cl. ..... 84/192; 84/291; 84/307; 84/309

[58] Field of Search ..... 84/192, 193, 195, 84/209, 274, 275, 276, 277, 291, 309

[56] References Cited

U.S. PATENT DOCUMENTS

| | | | |
|---|---|---|---|
| 572,897 | 12/1896 | Howe | 84/192 |
| 605,942 | 6/1898 | White | 84/276 |
| 3,691,891 | 9/1972 | Delu | 84/275 |
| 4,144,792 | 3/1979 | Machara | 84/188 |
| 4,667,559 | 5/1987 | Plesua | 84/309 |

FOREIGN PATENT DOCUMENTS

| | | | |
|---|---|---|---|
| 247995 | 7/1926 | United Kingdom | 84/275 |

*Primary Examiner*—Cassandra C. Spyrou
*Attorney, Agent, or Firm*—Tarolli, Sundheim, Covell, Tummino & Szabo

[57] ABSTRACT

A vibrating body for producing vibrations in the audible frequency range, has a non-uniform thickness and comprises a sound board having an axis. A first series of areas of reduced thickness is formed on the sound board at different distances from the axis and from each other. A first one of the areas of reduced thickness is spaced apart from a second one of the areas of reduced thickness by a first distance. The second area of reduced thickness being spaced apart from a third one of the areas of reduced thickness by a second distance. The third area of reduced thickness being spaced apart from a fourth one of the areas of reduced thickness by a third distance. The first distance and the second distance and the third distance vary in a harmonic progression.

12 Claims, 11 Drawing Sheets

Figure 1:
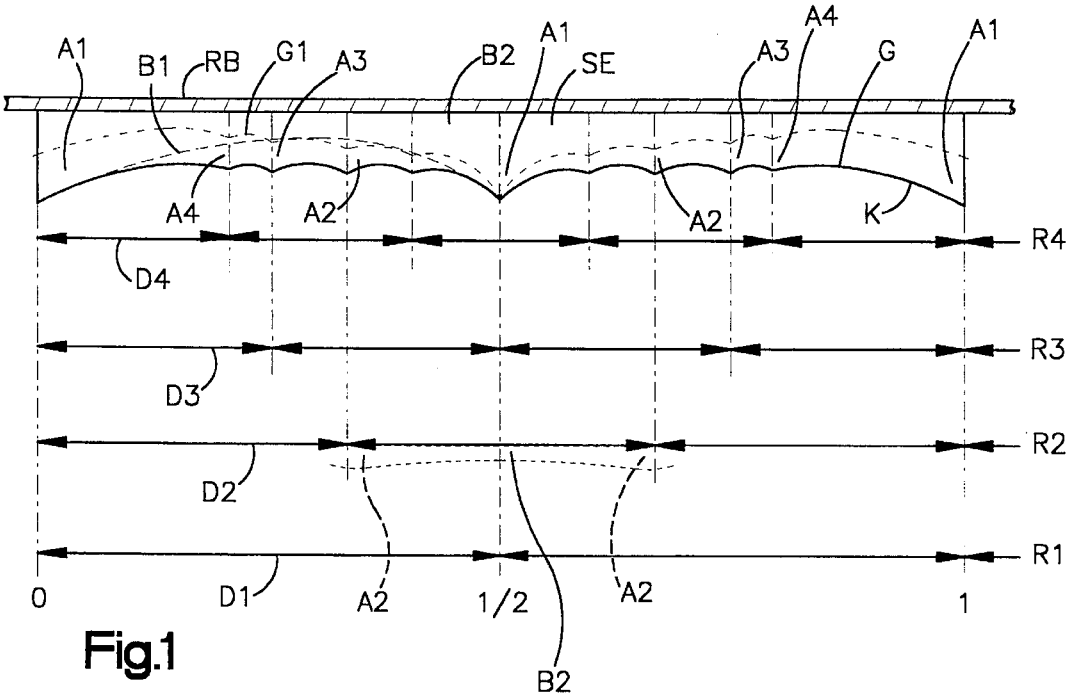

SOLID BODY CAPABLE OF VIBRATION AND/OR REFLECTION IN DEVICES AND INSTALLATIONS FOR GENERATING, RADIATING, DISTRIBUTING OR TRANSMITTING SOUND VIBRATIONS

RELATED APPLICATIONS

This application is a continuation of U.S. patent application Ser. No. 08/117,543, filed Sep. 3,1993, (now abandoned); which is a continuation of U.S. patent application Ser. No. 07/573,280, filed Aug. 24,1990 (now abandoned); which is a continuation of U.S. patent application Ser. No. 07/399,369, filed Aug. 24, 1989 (now abandoned); which is a continuation of U.S. patent application Ser. No. 07/277, 514, filed Nov. 21, 1988, (now abandoned); which is a continuation of U.S. patent application Ser. No. 07/307,051, filed Apr. 13, 1987 (now abandoned); which is a continuation of U.S. patent application Ser. No. 06/631,638, filed Jul. 17, 1984 (now abandoned).

The invention refers to a solid body capable of vibration and/or reflection in devices and installations for generating, radiating, distributing or transmitting sound vibrations. This species particularly includes structural elements and groups of such elements for musical instruments, such as vibrating or resonant plates or boards and vibrating or resonant hollow bodies, particularly sound cases, but also stiffening ribs, e.g. bass beams, supporting rods, particularly sound posts, bows, string bridges and string holders—these latter for strings and stringed instruments—as well as electromotively excited sound radiating and sound generating elements such as loud-speaker diaphragms. For these structural elements and groups it is functionally common that the solid body vibrations generally are formed in ranges which are thin-walled and elastically deformable by bending, i.e. in the form of standing waves with a vibrating direction transverse or under an angle to a surface of the solid body, such surface often working as a sound radiating or transmitting face.

A substantially different class of solid bodies for generating and radiating sound, which also belongs to the species of the invention, is constituted by hollow bodies, particularly tubular ones, in which standing air vibrations are formed, i.e. in tubular elements of most different kinds such as in use for wind instruments, with a longitudinal vibrating direction substantially according to the longitudinal direction of the tube. There the solid body determines the sound spectrum by the shape and dimensions of its cavity, but the body not necessarily participates in vibration.

A further class of hollow bodies comprised by the species of the invention are sound distributing rooms such as concert halls etc., which also substantially do not participate in vibration and in which no standing waves are formed, but which determine the sound pattern to be heard in the room by the shape and dimensions of their cavity as well as by the material properties as far as the capability of reflection and absorption is concerned.

With regard to the comprehensive species of the invention as explained above, it is the object of the invention to make possible for influencing the sound spectrum in a defined direction, particularly influencing the spectrum of the sounds generated, radiated or distributed in the space, and thereby to make possible esthetic improvements of the sound pattern or the suppression of distortion effects.

As investigations have shown, by the superpositional subdivisions or articulations as disclosed, the manufacture of which necessitates substantially merely the fulfillment of additional criteria as to shape and dimensions, but scarcely additional structural expenses, surprising improvements of the generally desired sound properties, particularly of the sound volume and capacity, or a sound distribution without disturbance is reached.

In the class of sounding solid bodies as mentioned first above, with standing transversal waves, which are transformed at the solid surface into longitudinal waves dissipating in the air space, the sound is influenced essentially by the discontinuous spatial, i. e. one—to three-dimensional distribution of the elastic deformation rigidity or by a complementary mass distribution according to the disclosed superpositional subdivisions. In this way the formation of nodes and antinodes is promoted in the sense of the desired spectrum or harmonic distribution. In the second mentioned class the formation of standing longitudinal waves within the air filling the cavity with their nodes and antinodes is directly influenced in the sense of a desired spectral distribution, particularly by means of a defined distribution of narrow and wide passages along the tube length—on principal without vibrations of the solid body itself. For hollow bodies of the third class substantially neither solid vibrations nor standing waves are of importance, but here rather the spectral distribution of the reflection and absorption capability is influenced in the sense of a distortion-free sound dissipation. In all cases a desired spectral modification is realized by means of the subdivisions according to the invention.

An essential further development of the invention has led to dimensioning mutually superimposed subdivision sequences, each of which being equidistant in itself, in such a way that the distances of these sequences, i.e. the distances between the regions of enhanced or reduced deformation rigidity or mass packing within one sequence each, are in an integer proportion, and particularly in case of greater numbers of superimposed sequences are forming a harmonic progression. Above all this leads to a considerable enhancement of the sound clearness or a decreased distortion factor.

Figure 2:
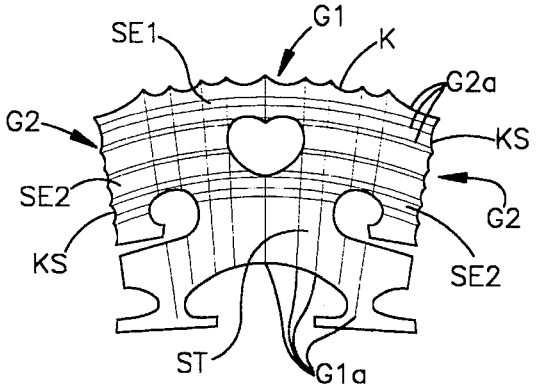
Figure 3:
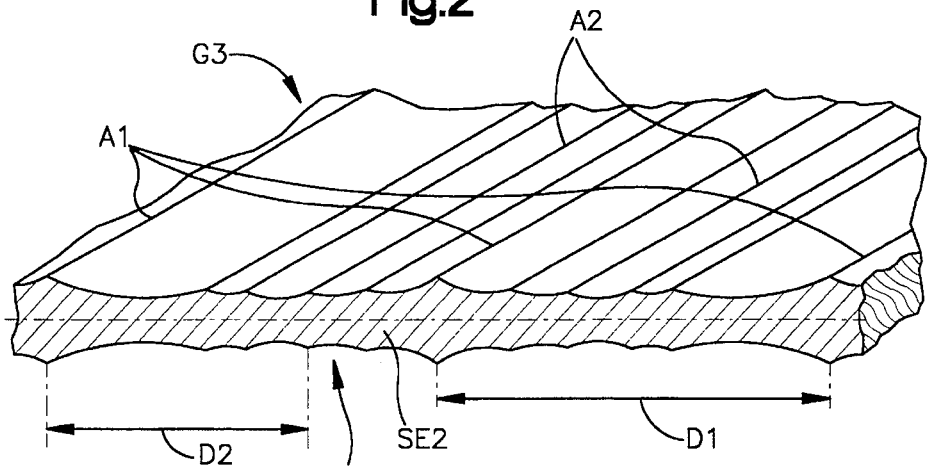
Figure 4:
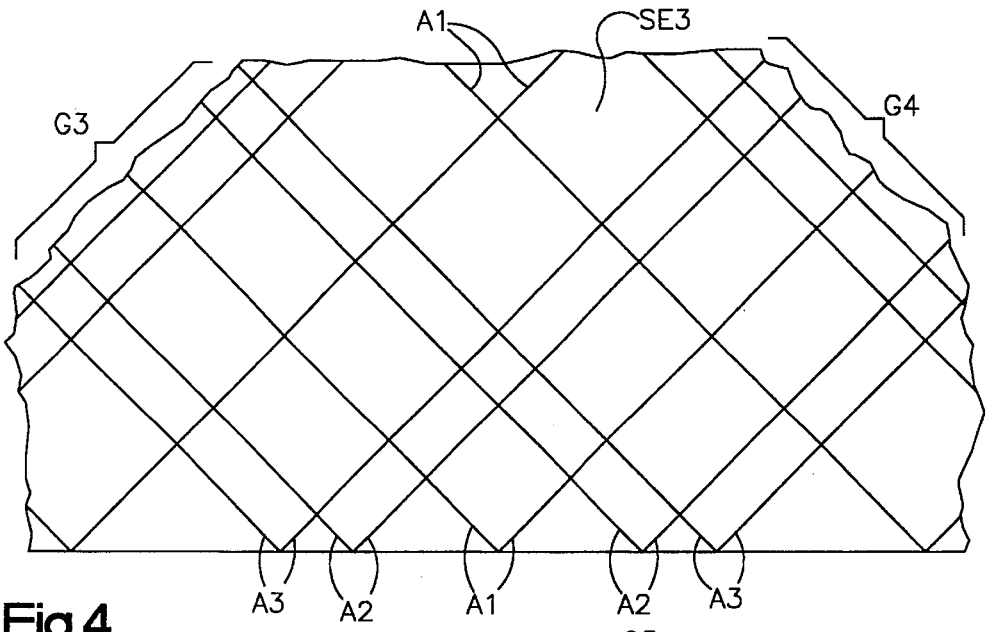
Figure 5:
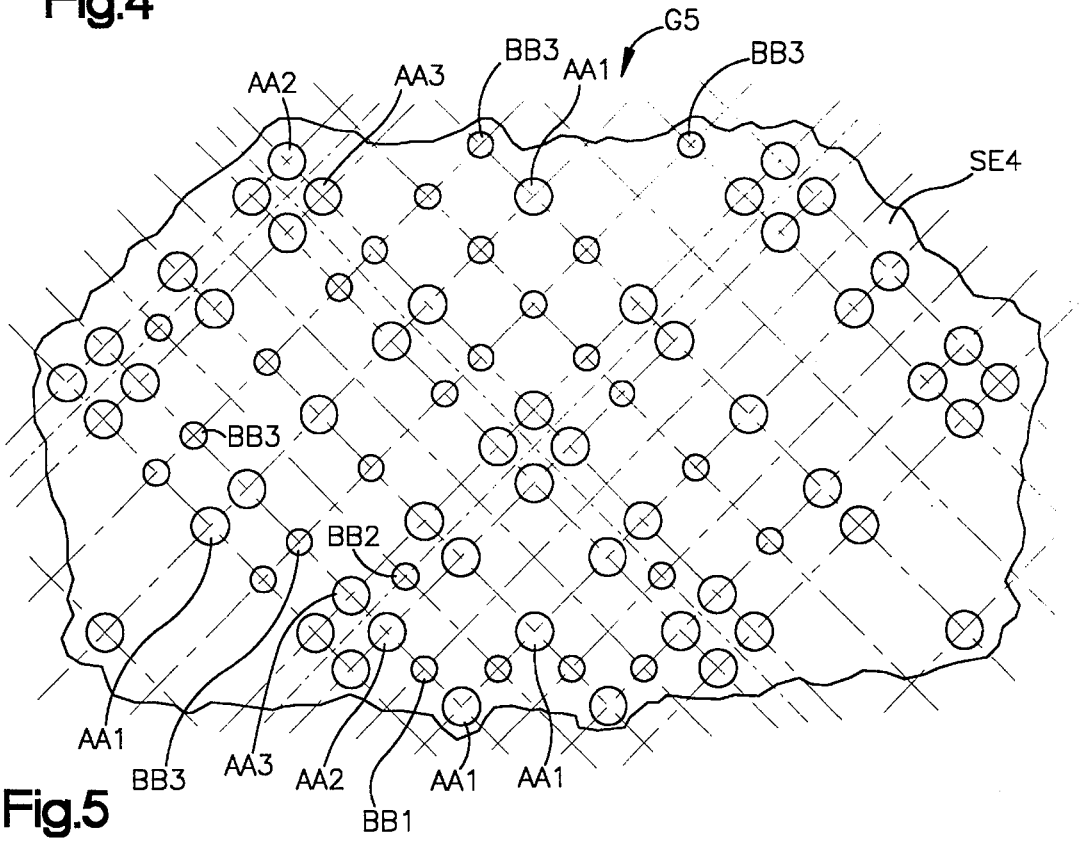
Figure 6:
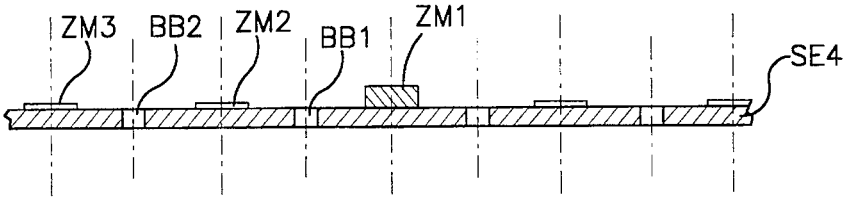
Figure 7:
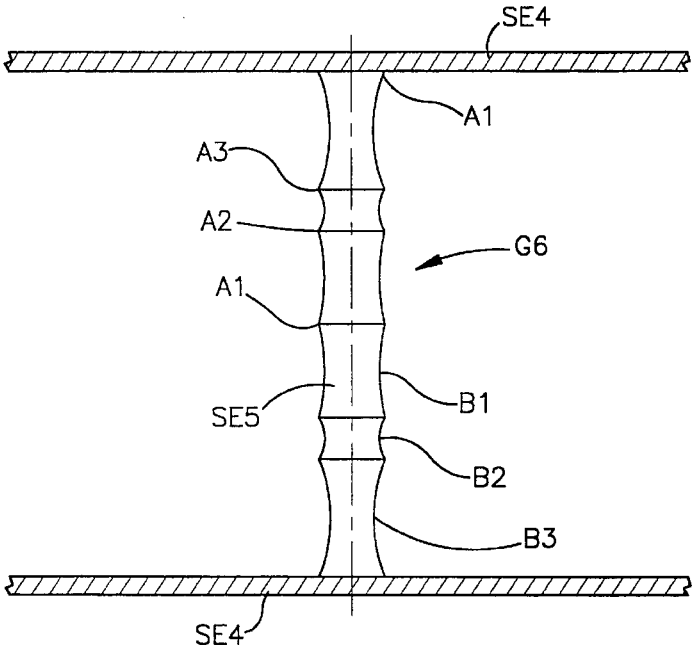
Figure 8:
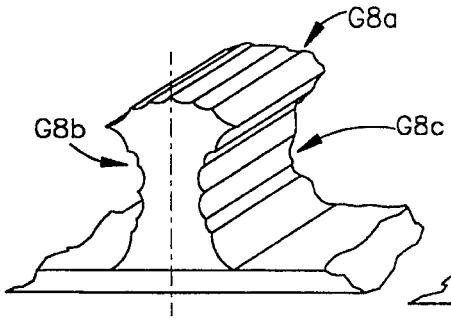
Figure 9:
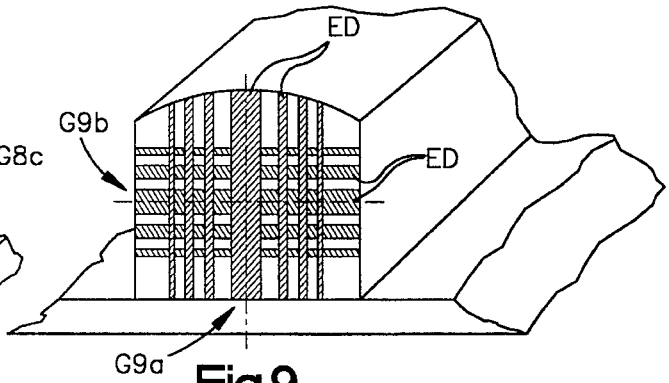
Figure 10:
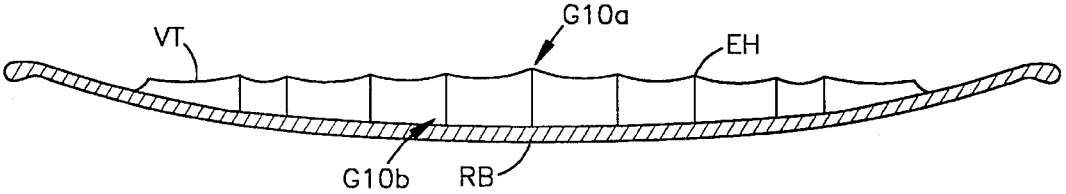
Figure 11:
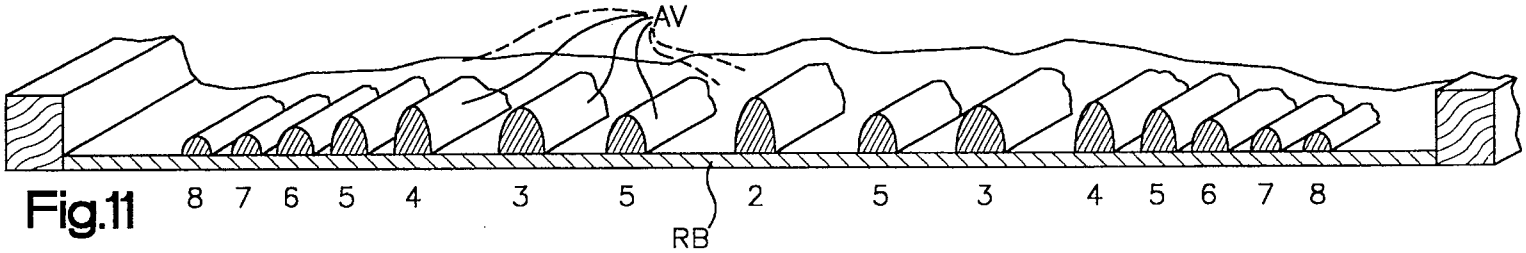
Figure 14:
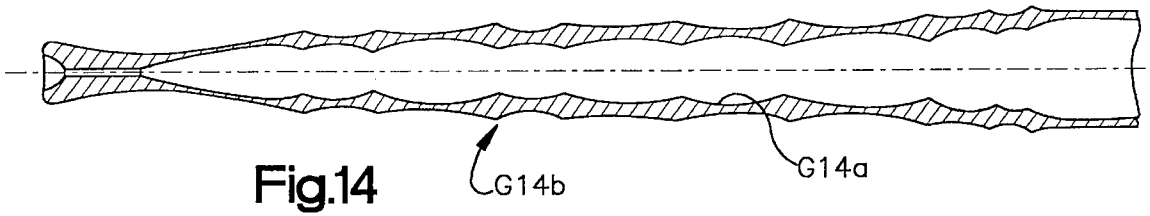
Figure 15:
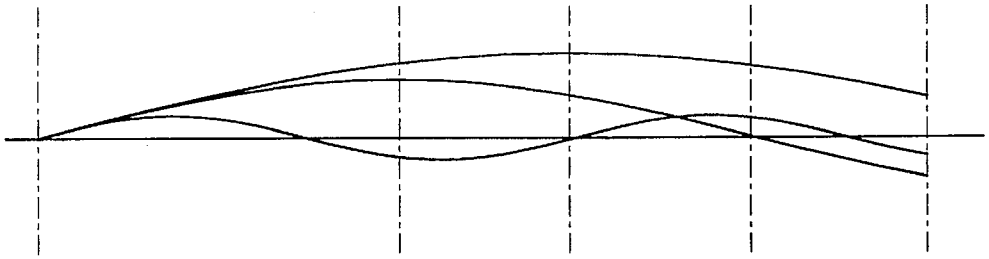
Figure 13:
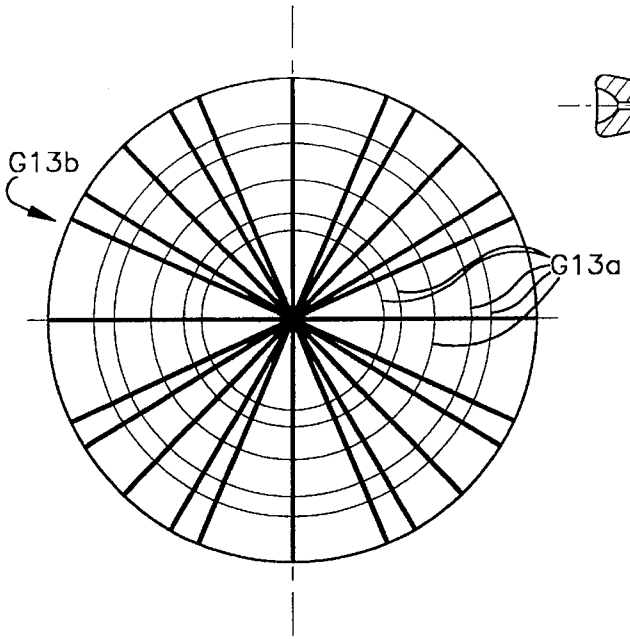
Figure 12:
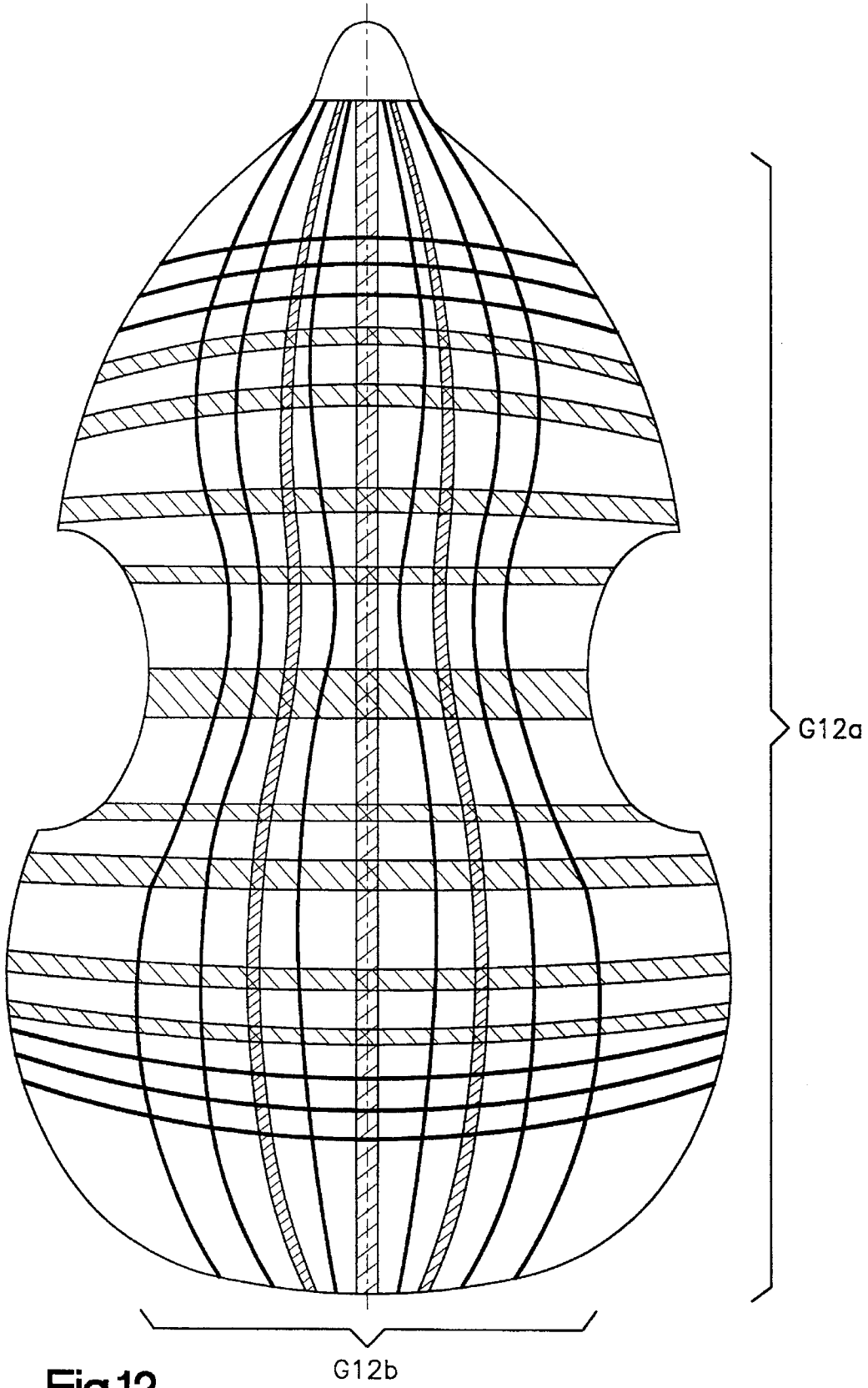
Figure 16:
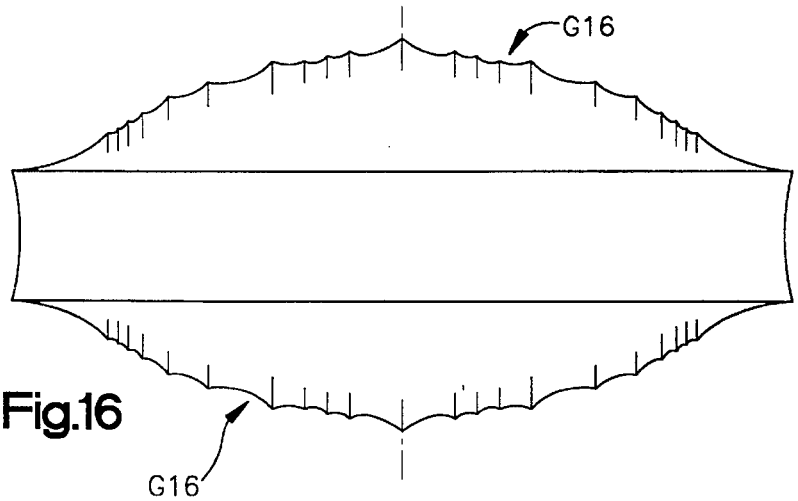
Figure 18:
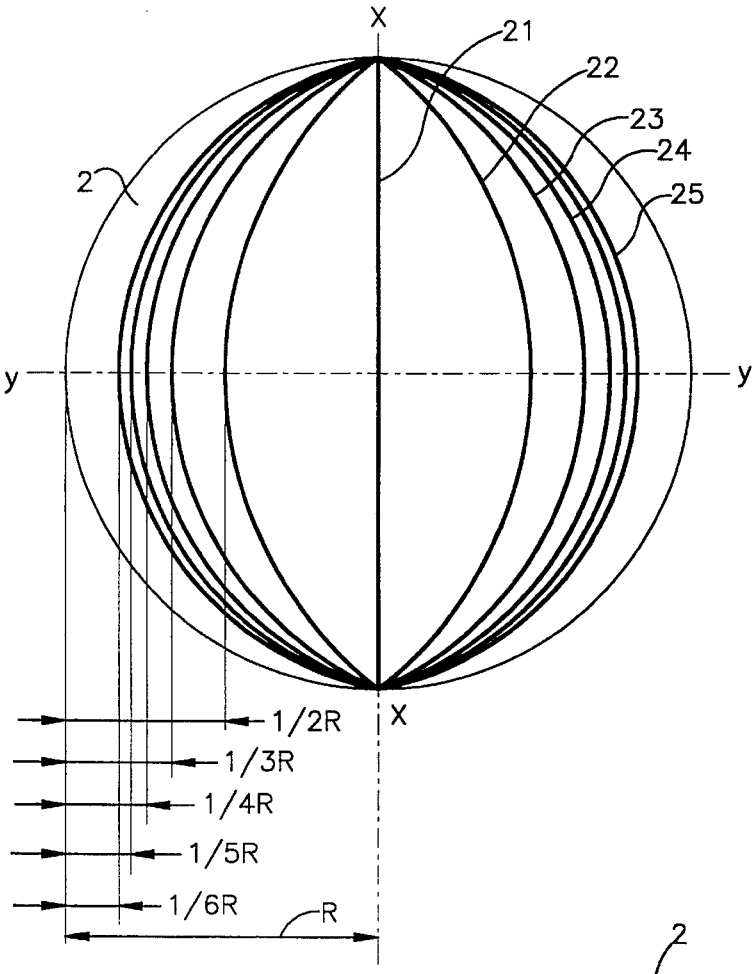
Figure 19:
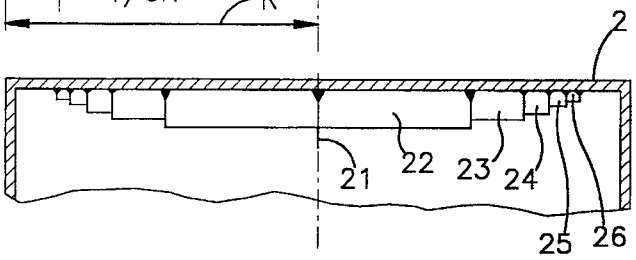
Figure 17:
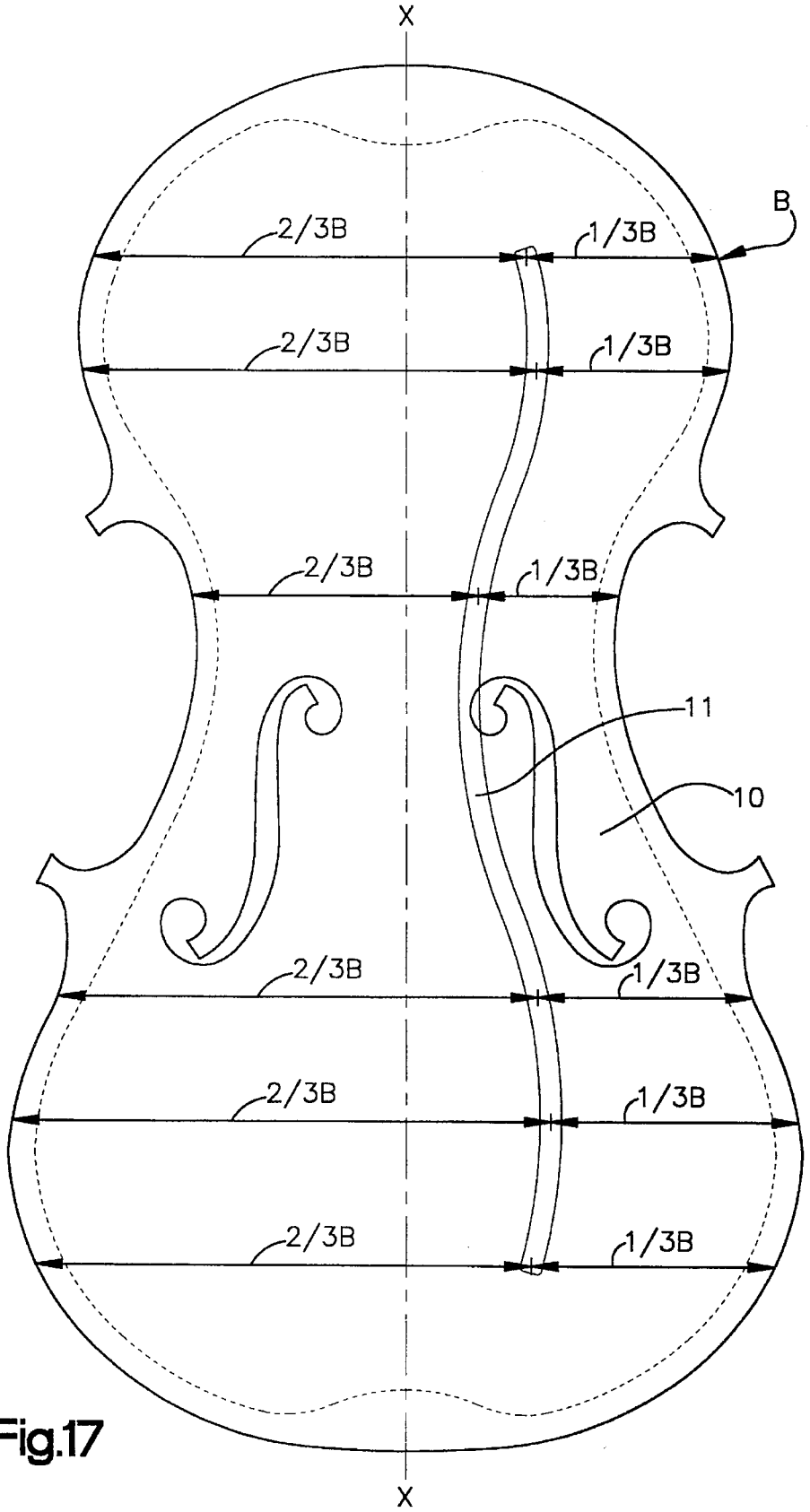
Figure 20:
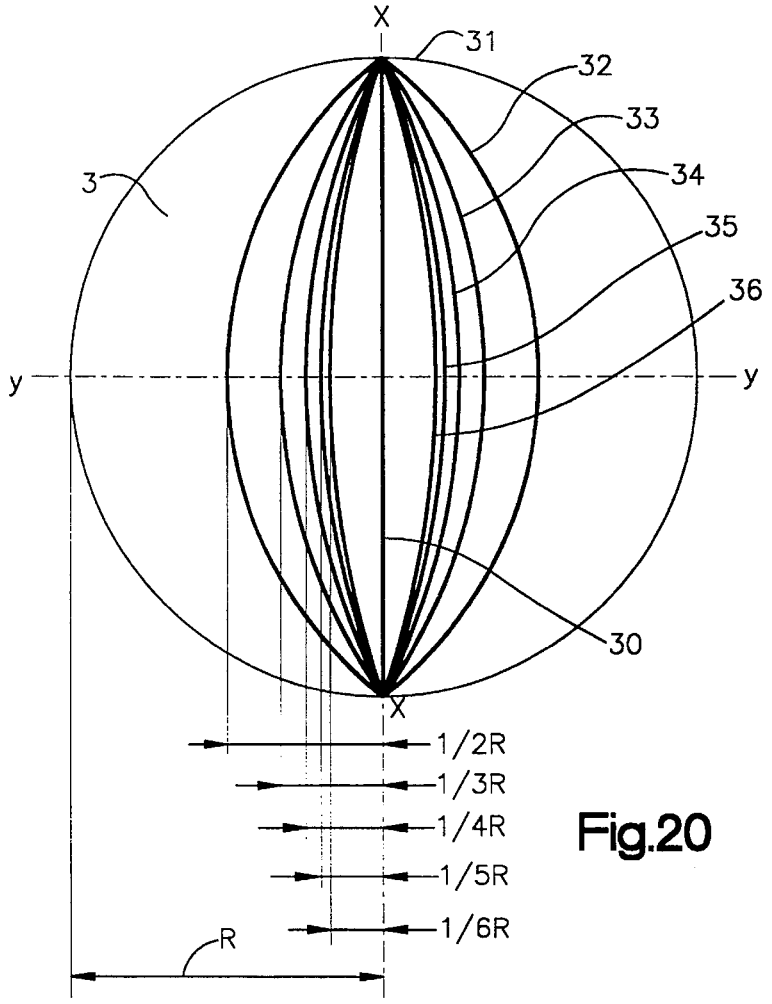
Figure 21:
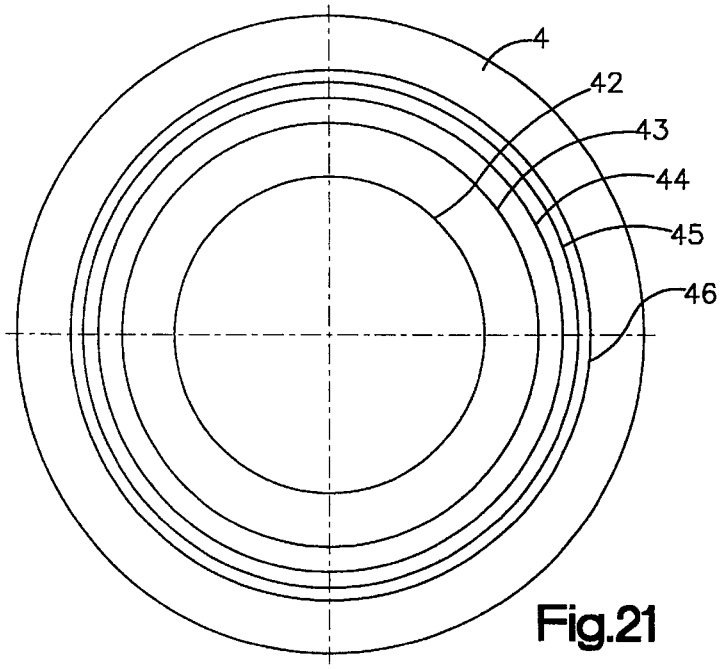
Figure 22:
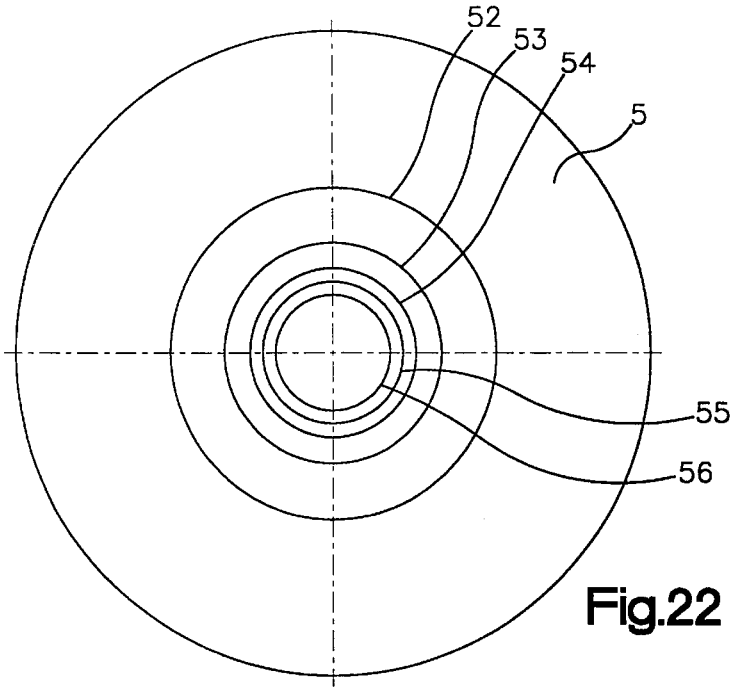
Figure 23:
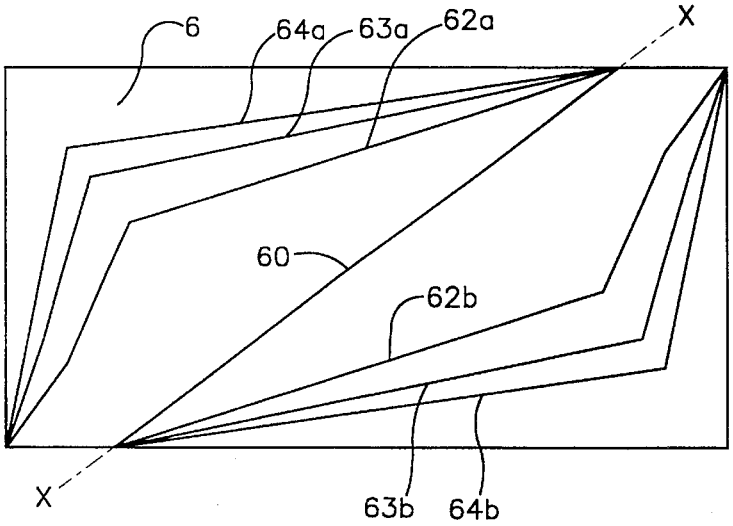
Figure 24:
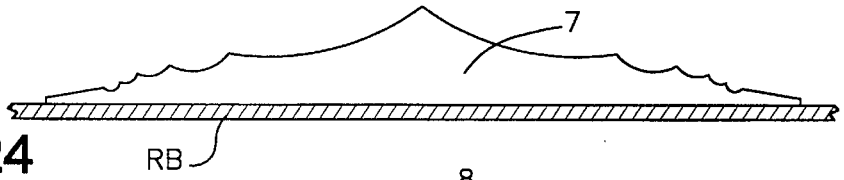
Figure 25:
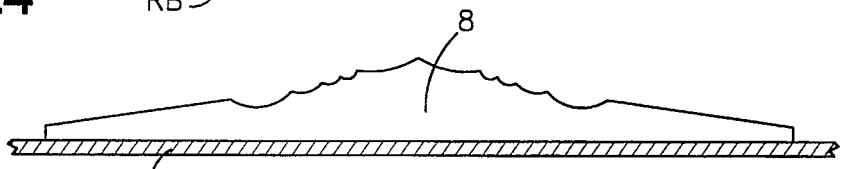
Figure 26:
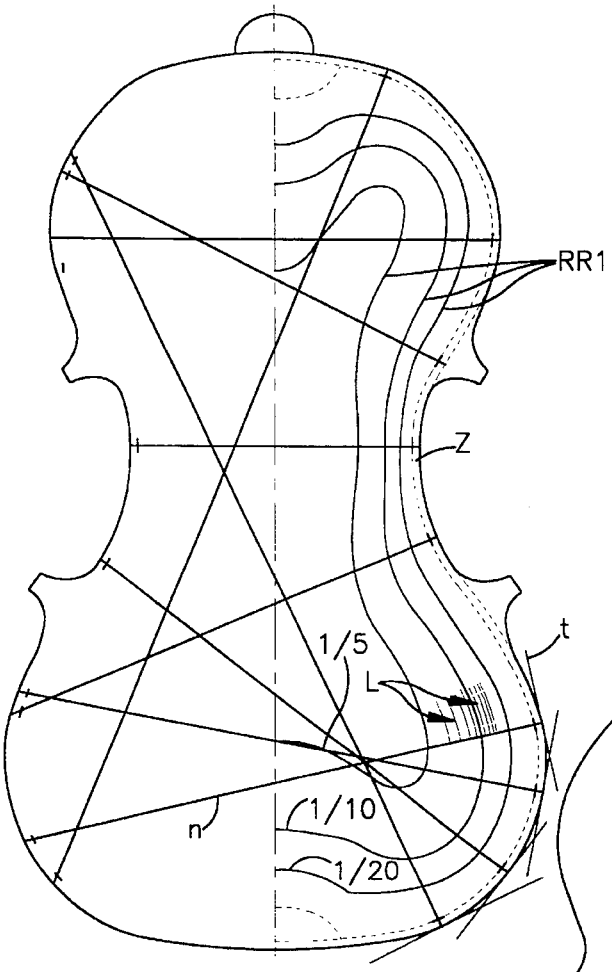
Figure 27:
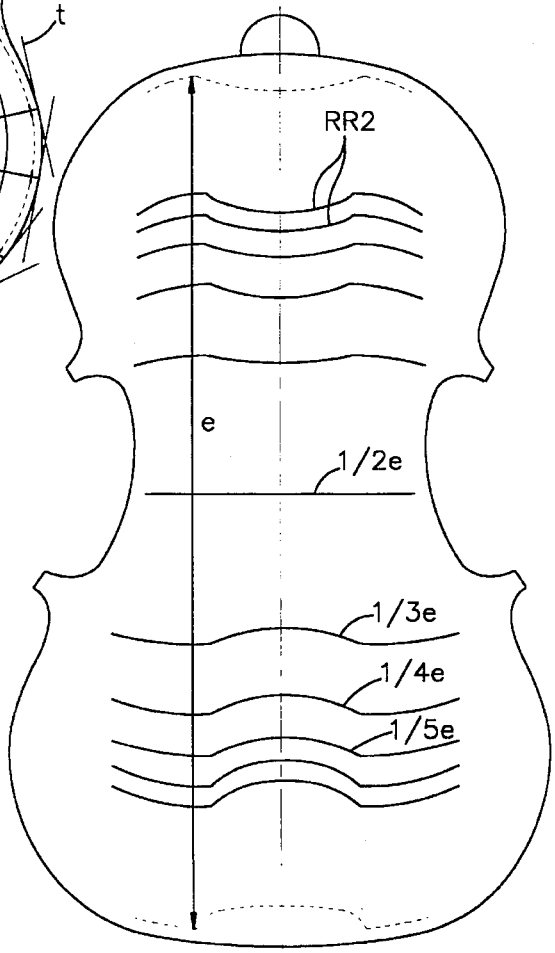
Figure 28:
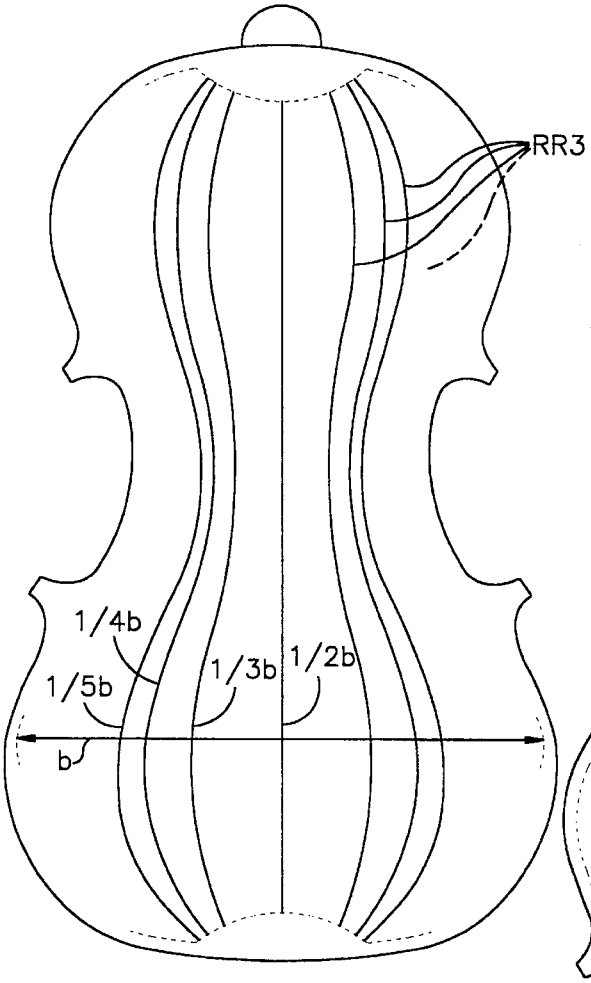
Figure 29:
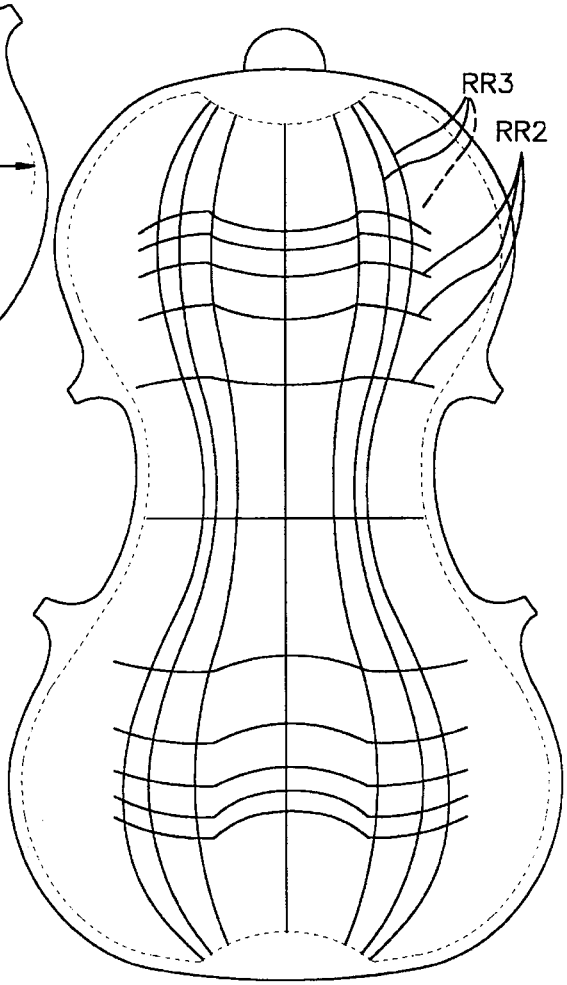

The invention will be further explained with reference being made to the examples schematically shown in the drawings. Therein shows:

FIG. 1 a profile view of a rib-like vibration element provided with superpositional subdivisions, FIG. 2 a front view of a violin string bridge as a vibration body provided with superpositional edge-subdivisions, FIG. 3 a perspective part-sectional view of a resonant floor provided with superpositional subdivisions, FIG. 4 a plan view of a surface of a vibration body with multiple superpositional subdivisions indicated schematically, FIG. 5 a schematic plan view of a vibration body surface with grid-like distributed regions of different mass packing, FIG. 6 a simplified cross section of a plate-like vibration element with different additional elements and with openings for influencing the vibration-mass packing, FIG. 7 a partial side view of a rod-like vibration element with a superpositional subdivision, FIG. 8 the cross-section of a stiffening rib with a planar superpositional subdivision extending over the circumference of the rib, FIG. 9 the cross-section of a stiffening rib with embedded high-density material distributed according to superpositional subdivisions, FIG. 10 the contour shape of a curved stiffening rib, the cross-sectional height of which is dimensioned according to a superpositional subdivision, FIG. 11 an arrangement of stiffening ribs, distributed over a resonant plate, with a distribution of the cross-sectional height over the rib number according to a superpositional subdivision, FIG. 12 a planar distribution of stiffening ribs in two systems crossing each other, partly being curved, on a resonant floor of a stringed instrument, with distances dimensioned according to two super-imposed subdivisions, FIG. 13 a plan view of a loudspeaker diaphragm with radial and circular, linear stiffening or mass enhancing elements, and with distances dimensioned according to corresponding superpositional subdivisions, FIG. 14 a wind instrument tube shown in a longitudinal section, variably dimensioned along the tube length according to a superpositional subdivision, FIG. 15 the harmonic distribution of the standing longitudinal waves appearing in the tube according to the superpositional subdivision, and FIG. 16 a schematic representation of a concert hall shaping as to its height and width and with profiling of its inner surface according to a superpositional subdivision, FIG. 17 a plan view of a violin resonant cover with a subdivision as to its width by a bass beam according to the invention, FIG. 18 a schematic, internal plan view of a cylindrical resonant body articulated over its width by means of stiffening ribs fastened on the internal surface of the coverplate, FIG. 19 a partial axial section of the resonant body according to FIG. 18, FIG. 20 a modified realization of a cylindrical resonant body represented in a plan view on the cover plate of the cylinder, subdivided over its width by means of stiffening ribs, FIG. 21 a cylindrical resonant plate radially articulated by means of concentric ribs or grooves, FIG. 22 a modified realization of the plate subdivision according to FIG. 21, FIG. 23 the scheme of a rectangular resonant plate articulated by means of a system of ribs or grooves extending straight-lined by sections, FIG. 24 the subdivision profile of a stiffening rib on a resonant plate, FIG. 25 a modified profile of a rib-subdivision, FIG. 26 a schematic plan view of a violin cover or floor subdivided by means of orbital-like shaped ribs adapted to the contour of the plate, FIG. 27 a schematic plan view of a violin resonant element as shown in FIG. 26, subdivided over its height by means of ribs or grooves extending substantially transverse to the main string direction, FIG. 28 a schematic plan view of a violin resonant element as shown in FIG. 27, but subdivided over its width by means of longitudinal ribs or grooves adapted to the side contour of the resonant element, and FIG. 29 a combination of longitudinal and lateral subdivisions according to FIG. 27 and 28.

In FIG. 1 there is shown a stiffening rib in the form of a longitudinal extending vibration element SE connected in a shear-resistant manner with a resonant floor RB. Such an element can be widely used, e.g. in the form of a bass beam of a kind known per se. Besides its static bearing function in reinforcing the resonant cover against the pressure exerted thereon by the string tension, this element being part of the vibration body as a whole has substantial influence on the resonance spectrum and the vibrating transition behaviour, i.e. on the sound colour and the sound initiating behaviour of the string instrument.

While in general a continuously curved longitudinal profile shape, which diminishes towards the beam ends, is usual and while a substantially uniform subdivision along the beam length by means of equidistant reductions of the profile height is used with considerable effects, in the present case provision is made for a subdivision G of the longitudinal profile distributed in a non-uniform manner along the beam length, the subdivision consisting of the profile height additive superposition of four equidistant sequences R1 to R4. Each such sequence comprises regions A1, A2, A3 and A4 of enhanced bending-deformation rigidity as well as ranges B1, B2 etc. arranged alternatively with the latter ones and being of reduced bending-deformation rigidity. In the stiffened ranges there is also an enhanced vibration mass packing, as far as not by additional measures—such as a reduction of the profile width or a reduction of the cross-sectional surface in the middle region of the cross-sectional height, e.g. in the form of excavation or holes—a compensation or even an overcompensation of such mass enhancement is accomplished.

The vibration pattern of a resonant body in general consists of manifold superpositions of standing waves of different wavelength and amplitude. In the node regions there prevails a small or vanishing elastic bending deformation, in the antinode ranges a maximal elastic bending deformation. In the ranges of enhanced or reduced bending rigidity consequently the formation of vibration of nodes or antinodes respectively is favoured. Now, while a simple equidistant distribution of regions of enhanced and reduced rigidity favours the formation of a standing wave merely concentrated in the range of one resonance frequency, which in fact makes available certain desired enhancements within the resonance spectrum, the superposition of different equidistant sequences of ranges of enhanced and reduced rigidity renders possible the enhancement of a corresponding frequency band. This means the possibility of forming a sound pattern substantially improved as being well-balanced and multifarious.

By choosing the distance values D1, D2 etc. (compare FIG. 1) of the mutually superimposed sequences and by choosing the ratio values thereof the ranges of the resonance spectrum, in which the enhancements appear, can be adjusted in a desired and reproducible manner to a great extent. In the interest of a well-balanced spectral behaviour and of a desired adjustment of continuous transitions therein the rigidity differences within the sequences may be dimensioned differently, advantageously in such a manner that these differences are stepped from sequence to sequence in a sense equal to the distance values. Such an embodiment has been indicated in FIG. 1 by the profile contour represented by a continuous line. The partial contours of sequences R1 and R2 have been shown by dash lines. On the other side, in the interest of especially soft transitions the rigidity difference may be varied within one and the same sequence also, such as in a manner so as to decrease towards both sides starting from the central point of the vibration element or of a section thereof. E.g. this leads to a subdivision G1 as shown in FIG. 1 by dash-dot lines.

For the clearness of sound as it is generally desired, dimensioning the distances D1, D2, . . . according to integer proportions is essential. It is useful to observe this condition in case of a small number of superimposed sequences also. In case of extensive superpositions it is advisable to dimension the distances D1, D2, D3, . . . according to a harmonic progression, i.e. according to a longitudinal division of a vibration element section in the proportion ½, ⅓, ¼ etc. Therewith eminent effects with regard to abundance and clearness of sound have been reached, particularly with string instruments.

FIG. 2 shows the application of the disclosed subdivision to a plate-shaped vibration element, i.e. a string supporting bridge of a bowing instrument, where a subdivision G1 of the kind shown in FIG. 1 extends along an edge K of the bridge. Shortened subdivisions G2 are further provided at the side-edge sections KS of the bridge ST, which functions as a multisection vibration body with vibration elements SE1 at the edge K and SE2 at the side-edge KS. For this case of application a practically verified, eminently high sound effectiveness even by means of comparatively slightly pronounced subdivisions has to be pointed out. Assumedly this is due to a frequency-selective coupling effect of the bridge between sound producing strings and the resonant hollow body of the instrument's body, besides to a noticeable participation in the direct sound radiation.

FIG. 3 shows a plate-shaped vibration element SE2 with a superpositional subdivision G3 at both surfaces. These subdivisions in their cross-sectional profile are in accordance with the superpositional edge-subdivision G of FIG. 1 as already explained. The regions of enhanced or reduced bending stiffness respectively are forming here a system of juxtaposed, longitudinally extending ridges or grooves respectively, which transversely to their longitudinal direction form superpositional subdivisions of the kind explained already. Such embodiments should be taken into consideration for an eminently strong global efficiency on resonant floors of most different kind, particularly on resonant floors or plates in mechanized plucking instruments and on wall elements of resonant hollow bodies for string instruments, above all for bowing instruments.

FIG. 4 represents in a schematical manner the possibility of further refining a superpositional surface-subdivision, i.e. in the form of two systems of ridge-shaped regions A1, A2, A3 of enhanced bending rigidity, these systems crossing each other on one surface of a plate-shaped vibration element SE3 and forming two superpositional subdivisions G3 and G4 in the kind of FIG. 3. Between the ridge-shaped regions there are formed groove-shaped regions of reduced bending rigidity, not being provided with reference symbols for the sake of clearness. Subdivisions of this kind allow for a well-defined influence on two-dimensional standing wave patterns and should be taken into consideration for enhanced efficiency particularly with more ample resonant assemblies.

In cases where portions of plate-resonators with an extraordinarily diminished remaining cross-sectional thickness are to be avoided, a crossing arrangement of a ridge-groove subdivision on each of both plate surfaces is recommended.

Similar subdivisional effects on principle can be obtained with the aid of a non-uniform mass distribution also, particularly with plate-resonators. Presuming a uniform distribution of the deformation rigidity, the preferred locations of wave nodes and antinodes are interchanged, i.e. in regions of increased vibration mass preferably wave antinodes, and in regions of reduced vibration mass wave nodes will appear. Obviously the marginal and fixing conditions of the vibration element section must be compatible with such a wave formation, which is valid correspondingly for rigidity subdivisions also. When regarding these conditions, combined rigidity and mass subdivisions can be applied with advantage. By the way—as indicated already—non-uniform mass distributions generally will appear also with a non-uniform rigidity distribution. However, in case of rigidity variations by means of accordingly dimensioning the cross-sectional height of a bending vibrator, as generally to be adopted, the effect of mass-enhancement in a region of enhanced cross-sectional height is comparatively slight, because the rigidity is effective in accordance with a higher power of the cross-sectional height due to its dependence on the cross-sectional moment of inertia. Then in many cases the mass enhancement can be neglected, but in any case it does not disturb generally.

On the other side mass subdivisions without substantial influence on the rigidity can be obtained advantageously also in view of the production, by means of projections or depressions resp., which are limited on all sides within the vibrating surface, i.e. which are of a dot-like shape. Such projections or impressions can be formed particularly as holes of small planar dimension within a plate-shaped vibration element, while for regions of enhanced vibration mass packing the application of additional masses is favourable. In this way particularly rigidity and mass subdivisions can be combined with mutually enhancing efficiency.

FIG. 5 shows a grid-like mass subdivision G5 extending over the surface of a plate-shaped vibration element SE4 having circular regions AA1, AA2, . . . of enhanced vibration mass regions AA1, AA2, . . . and equally shaped regions BB1, BB2, grid distribution is in accordance with a two-dimensional subdivision along crossing line systems according to FIG. 4.

Thereto FIG. 6 shows the structure of regions BB1, BB2, . . . formed as holes within the thin-walled plate element and the structure of regions of enhanced mass formed as additional mass elements ZM1, ZM2, ZM3, . . . . The latter ones, e.g. in the form of simply shaped, button-like elements can be fixed by glue. In the production there is a especially advantageous possibility of application for elements ZM2 and ZM3 in the form of thin layers consisting of a material of high density, as which heavy metals and their alloys, particularly noble metals also, fall into consideration. These elements can be produced conveniently in the form of foil segments and fixed by glue, but also in the form of moulding compounds or varnish filled with metal. The latter has the special advantage of simplicity as to production.

As an example of a further possible main application for superpositional subdivisions FIG. 7 shows a rod-shaped vibration element SE5 in the form of a sound post within a resonant hollow body of a string instrument. The subdivision G6 with its ridge—and groove-shaped regions A1, A2, A3 and B1, B2, B3 of enhanced and reduced bending rigidity resp. surrounds the circumference of the rod-shaped vibration element. With coupling elements subdivided in such a manner also remarkable sound improvements can be obtained according to practice. The neighbouring, plate-shaped vibration elements SE4 of the hollow body advantageously are also provided with superpositional subdivisions of the kind described before, by means of adjusting the dimensions of the subdivisions eminent global results being obtainable.

The cross-sectional design of a stiffening rib according to FIG. 8 is based on the knowledge that even in comparatively compact objects transverse vibrations being relevant for the sound appear in the solid body, i.e. in the present case among others bending vibrations in different directions parallel to the cross-sectional face. Standing waves having their longitudinal direction transverse to the rib's longitudinal direction there are favoured in forming a harmonic progression by means of the regions of enhanced and reduced bending rigidity resp. distributed according to superposition subdivisions G8*a, b, c*. Similar effects can be obtained by means of regions or elements ED of enhanced density according to the rib embodiment of FIG. 9 being embedded in the vibrating solid body and arranged in the form of two superpositional subdivisions penetrating each other at right angles.

FIG. 10 again shows a stiffening rib with subdivision as to its edge and cross-sectional height, but with the cross-sectional height decreasing in the average towards the ends and with globally curved shaping for adaption to a vaulted resonant floor R8 as is common in string instruments. In addition to the subdivision of the edge and cross-sectional height G10*a*at the flanks of the rib provision is made for superpositional subdivisions G10*b* with wave-shaped depressions VT and ridge-shaped projections EH running in the direction of the rib's height, that is e.g. with a longitudinal extension of the subdivision set off rectangularly , i.e. in the rib's longitudinal direction, in relation to the subdivision G8*a, b* in FIG. 8. Therefore, the effect corresponds to the edge subdivision G10*a*, the longitudinal extent of which is also in accordance with the rib's longitudinal direction.

FIG. 11 shows a superposition on a plain resonant plate as in pianos and grand pianos, with rib-shaped mounted stiffening elements AV. Here the subdivision extends merely in a direction transverse to the ribs, while in the rib's longitudinal direction there are homogeneous conditions. For the sake of clearness the single ribs have been designated merely by the ordinal numbers 1 to 8 of the corresponding harmonics according to the denominator of the distance pitch of the superposition sequence in question.

The rib's height and, therewith, the stiffening effect decreases with the ordinal number, which according to practice contributes to a variation of the harmonic amplitudes satisfactory for a well-balanced sound pattern. Moreover, such a substantially one-dimensional subdivision (merely in the rib's transverse direction) favours the formation of standing waves merely in one direction of the plate.

In contrast thereto FIG. 12 shows the plan view of a resonant floor with two superpositional subdivisions G12*a* and G12*b* penetrating each other substantially crosswise, i.e. as a whole forming a two-dimensional subdivision. The elements of the subdivision can be provided so as to be stiffening elements or complementary, strip-shaped regions of reduced bending rigidity, but also as regions of enhanced or reduced mass packing resp. Slender ribs or bridges combined with comparatively broad interstices have little stiffening effects, such that the mass enhancement generally associated with the cross-sectional height enhancement prevails. In detail the dimensioning generally has to be defined so as to render the desired effect. Starting with a homogeneous bending vibrator, locally concentrated stiffenings are favouring the formation of nodes, corresponding mass concentrations, however, the formation of antinodes. Since without special provisions, e.g. in case of a local cross-sectional height enhancement, bending rigidity and mass packing generally are influenced in common, appropriate discrimination has to be taken care of, such as by means of material excavations in the range of the neutral bending zone (stiffening without mass enhancement) or by unravelling ranges of enhanced cross-sectional height by means of slots transverse to the bending direction or the longitudinal wave direction (mass concentration without stiffening).

In the embodiment of FIG. 12 the distances between elongated regions of enhanced bending rigidity (in their longitudinal direction) compared with the interstices, e.g. the distances between stiffening ribs, are so provided as to be variable in the longitudinal direction of these regions over the extent of a subdivision system G12*b*, i.e. according to curves adapted to the margin contour of a plate-shaped vibration body. According to practice this will render a utilization of the vibration body for a harmonic shaping of the spectral distribution, which is especially intense and uniformly distributed over the whole surface. Here also the variation amplitudes of the vibration parameters (rigidity or mass packing) can be designed to be variable from one superposition sequence to the other or—similar to FIG. 10—within each such sequence, preferably decreasing from the middle to the ends.

As a further example FIG. 13 shows a circular-shaped loud-speaker diaphragm with two orthogonal mass-concentration superpositional subdivisions G13*a* and G13*b*, e.g. in the form of strip-shaped mass mountings or inserts on or in the diaphragm material resp., such as in the form of varnish weighted with metal granulates. In a diaphragm-shaped vibration body such mass concentrations can be produced in general more easily than stiffening concentrations.

The wind instrument tube shown in FIG. 14 by a longitudinal section, is provided with a superpositional subdivision G14*a* running in the longitudinal direction of the tube and consisting of narrow passages ES and wide passages WS being both symmetrical as to rotation about the tube axis. Contrary to solid vibration bodies here the air column in the tube directly constitutes the primary vibration medium, in which case the sound radiation per se can take place by dissipation of progressing sound waves from the tube mouth into the space without the tube or solid body participating in the vibration. In view of the nature of the primary vibrations as longitudinal standing waves, i.e. with axially flowing air, the narrow passages are capable of favouring the formation of regions with locally enhanced flow velocity, i.e. of wave antinodes of the sound vibration velocity. The inverse is valid correspondingly for favouring nodes of the sound vibration velocity in the regions of wide passages of the tube cross-section. Here also the sequence of narrow and wide passages according to a preferably harmonic superpositional subdivision makes possible a well-defined influence on the spectrum and, thereby, an improvement of the sound pattern.

Additionally the tube, i.e. the solid body, can participate in exerting influence on the sound, above all in the sound radiation, by means of vibrations of its own according to the vibration conditions prevailing in its internal space, which latter ones are acting as a stimulation for vibrating. For this purpose in the example also the external tube surface is provided with a superpositional subdivision G14*b* congruent to the one at the internal surface.

Moreover, in case of being shaped with sharp edges in the kind of orifice plates the narrow passages are capable of having a perceptible damping effect, which can be used for special effects with regard to attenuating specific spectral ranges or harmonics. In the example such sharp-edged narrow passages have been indicated. If local damping is not desired, rounding off the profile or a jet-like shape of the narrow passages should be preferred.

Generally it has to be regarded that the walls of the solid body in being the limitations for the vibrating air column, are standing under a periodically varying internal pressure and, therefore, are stimulated to transversal vibrations (in contrast to the longitudinal vibrations of the air column). Thus here similar conditions appear as in a thin-walled resonant body, which transfers its transversal vibrations or standing waves to the surrounding air in the form of dissipating running waves having a direction transverse to the surface of the solid body. Since the nodes of the sound vibration velocity on one side and the nodes of the sound vibration pressure on the other side are off-set against each other (under simple conditions node and antinode locations are mutually interchanged), it may be advantageous to set off the internal and the external subdivision against each other accordingly with regard to mass concentrations and stiffening locations resp FIG. 16 shows the cross-section of a sound distributing room with a convex curved superpositional subdivision G16 at the floor and the ceiling. The subdivisions extend in parallel to room's cross-section from the central vertical plane towards both sides. Such a subdivision comes in question for the longitudinal direction (in relation to the sound irradiation side, not shown here) of the room also and, moreover, a corresponding two-dimensional superposition or penetration of the subdivisions in both directions.

The effects to be obtained here obviously are not based on the formation of standing waves in space, and neither on solid body vibrations with wavelengths in the range of the dimensions and subdivision distances being great in this case. Rather here it is about taking a well-defined influence on the three-dimensional sound pattern by means of enhanced reflection and absorption regions, where the profiling in the convex regions makes possible a globally well-balanced sound replenishment of the room by means of superposition.

Finally it has to be pointed out that not only the spatial distribution of favouring standing wave nodes in a harmonic manner, but also a corresponding damping distribution can be used for a well-defined sound improvement, as the case may be. The distribution characteristics disclosed for a concentrated arrangement of stiffenings and masses or of narrow and wide passages consequently are applicable for damping regions and damping elements also. Pronounced damping effects can be accomplished by using known material properties.

The violin cover shown in FIG. 17 is subdivided in the proportion ⅓ to ⅔ of the width extent B of the cover body 10 by means of a bass beam 11 extending over the height extent of the cover body. Thereby a pronounced sound abundance in the medium range of the spectrum can be obtained as in many cases desired for a certain sound character.

A circular-shaped cover plate 2 of a cylindrical resonant body according to FIG. 18 and 19 is subdivided with regard to its width as measured crosswise to a predetermined privileged direction X—X by means of ribs or grooves 21 to 25 in the harmonic proportions 1/R to 1/6R, i.e. such that the subdivision distances are decreasing from the middle to the margin of the cover plate. By means of such a subdivision according to a harmonic progression a well-balanced sound abundance can be obtained in a wide range of the spectrum. Therein the compression of the linear or elongated subdivision elements in the case of having the latter ones formed as rigidity-reducing grooves tends to compensate the rigidity of the resonant plate, which per se increases towards the margin because of the plate being fixed there to the frame Z, while forming the subdivision elements as stiffening ribs tends to the contrary effect. Corresponding complementary effects will appear with subdivision elements, which are effective in the direction of reducing or enhancing the mass packing of the resonant plate by means of excavations or putting masses on respectively. In this context the combined effect as to rigidity and mass packing with regard to width and height or depth as well as of the profile shape of the ribs or grooves as applied in the single case has to be considered, i.e. two contrarily effective components, so as to avoid a mutual compensation of both effects. There it is further to be understood that the mass packing as a scalar magnitude lacks a directional effect with respect to the different directions within the resonant surface, while the bending rigidity on principle is a directional magnitude. Thus a rib generally causes a substantial enhancement of the bending rigidity merely in its longitudinal direction, but not so crosswise thereto. In this context it has also to be understood that linear subdivision elements can be formed as series of mountings or excavations, whereby the effect on the bending rigidity in the longitudinal direction can be reduced or compensated.

In the sense of the preceding explanations FIG. 20 shows a sub-division as to the width of a plate-shaped resonant body 3 according to the harmonic proportion values 1/1R to 1/6R in the transverse axis Y—Y by means of ribs or grooves 30 to 36 concentrated in the range of the longitudinal axis X—X.

Similar examples for a radial subdivision of a circular-shaped resonant plate 4 or 5 resp. with grooves or ribs 42 to 46 or 52 to 56 resp. have been indicated in the FIGS. 21 and 22 resp. It has to be understood that a combination or superposition of two or more of such subdivisions in case can be adopted with special sound effects.

Furthermore, FIG. 23 shows an example of applying a harmonic subdivision of a plane by means of ribs or grooves 62*a* to 64*a* and 62*b* to 64*b* being straight-lined by sections and extending on both sides of a subdivisional element 60 running along a given privileged direction X—X for a rectangular-shaped resonant plate 6. Such structures come into consideration e.g. for resonant plates in the piano or grand piano or the like. The privileged direction there can be given particularly by the fiber direction of a plate consisting of wood or by the main string direction. The application of such a sub-divisional structure to differing, but principally similar plate or frame shapes in the kind of a trapezoid or the like implies no special difficulties for the expert. It has to be understood that the course of the subdivisional elements, here shown to be angular, in practice can be shaped to be rounded. Further the privileged direction can vary over the extent of the plate, which entails an adaption of the harmonic distances accordingly.

In the FIGS. 24 and 25 application examples of a harmonic distance subdivision have been represented in the profile of a stiffening ribs 7 or 8 resp. on a resonant body RB, i.e. with concentration at the ends or in the middle of the rib length respectively. For the influence on the sound here also is valid what has been explained before.

FIG. 26 shows a harmonic subdivision of a violin resonant plate with orbital ribs or grooves RR1. The latter ones are subdividing the length, measured between the inner margins of the frame Z, of the normal line n related to each tangent line t in the harmonic proportions ⅕, 1/10 and 1/20. In case the distances between these subdivisional elements can be filled up by completion of the harmonic progression as indicated in the region L. Furthermore, on principle a concentration of the subdivisional elements towards the middle—here not shown particularly—comes in consideration also (compare above). The example shows the application to irregularly shaped plate contours, whereby a highly surface-covering subdivision of great efficiency as to the sound abundance is obtained.

The FIG. 26 to 29 are showing the principle of harmonic transverse and longitudinal subdivision as well as of superposing both subdivision patterns with ribs or grooves RR2 and RR3 in longitudinal or transverse distances 1/2.1 to 1/5.1 etc. or 1/2.b to 1/5.b etc resp. for a plate-shaped violin resonant body. These embodiments make possible also intensely surface-covering subdivisions, however, in contrast to the embodiment of FIG. 26 with an effect to be differentiated in a well-defined manner on the standing resonance waves extending in the longitudinal and transverse direction in the vibrating plate body.

The subdivision by simple harmonic progressions is essential for the example described lastly.

I claim:

1. A vibrating body for producing vibrations in the audible frequency range, said vibrating body having a non-uniform thickness;

said vibrating body having a first series of alternating areas of increased and decreased thickness;

adjacent areas of increased thickness of said first series being spaced apart from each other by a first predetermined distance which distance is the same between any selected pair of adjacent areas of increased thickness of said first series;

said vibrating body having a second series of alternating areas of increased and decreased thickness;

adjacent areas of increased thickness of said second series being spaced apart from each other by a second predetermined distance which distance is the same between any selected pair of adjacent areas of increased thickness of said second series;

said second predetermined distance being different from said first predetermined distance;

said second series of alternating areas of increased and decreased thickness being superimposed on said first series of alternating areas.

2. A vibrating body as set forth in claim 1 wherein said alternating areas of increased and decreased thickness in said second series extend transverse to and intersect said alternating areas of increased and decreased thickness of said first series.

3. A vibrating body as set forth in claim 1 wherein said alternating areas of increased and decreased thickness provide regions of increased bending stiffness or mass density arranged alternately with regions of reduced bending stiffness or mass density.

4. A vibrating body as set forth in claim 1 wherein the ratio of said first predetermined distance to said second predetermined distance is an integer ratio.

5. A vibrating body as set forth in claim 4 wherein the ratio of said first predetermined distance to said second predetermined distance is 2:1.

6. A vibrating body as set forth in claim 1 wherein said first and second series of areas of decreased thickness are formed as elongate grooves or depressions which extend generally parallel to each other when superimposed so as to provide said regions of said vibrating body which regions have a thickness which is a function of the thicknesses in said first and second series and which is different from any one of the thicknesses in said first and second series.

7. A vibrating body for producing vibrations in the audible frequency range, said vibrating body having a non-uniform thickness and comprising:

a sound board having an axis; and a first series of areas of reduced thickness formed on said sound board at different distances from said axis and from each other;

a first one of said areas of reduced thickness being spaced apart from a second one of said areas of reduced thickness by a first distance;

said second area of reduced thickness being spaced apart from a third one of said areas of reduced thickness by a second distance;

said third area of reduced thickness being spaced apart from a fourth one of said areas of reduced thickness by a third distance;

said first distance and said second distance and said third distance varying in a harmonic progression.

8. A vibrating body as set forth in claim 7 further comprising a second series of areas of reduced thickness which are formed on said sound board at different distances from said axis and from each other, said distances in said second series varying in a harmonic progression, said areas of reduced thickness in said second series being superimposed on said areas of reduced thickness in said first series.

9. A vibrating body as set forth in claim 8 wherein said first and second series of areas of reduced thickness are formed as elongate grooves or depressions which extend generally parallel to each other when superimposed so as to provide said regions of said vibrating body which regions have a thickness which is a function of the thicknesses in said first and second series and which is different from any one of the thicknesses in said first and second series.

10. A vibrating body as set forth in claim 7 wherein said harmonic progression in at least one of said first and second series of areas of reduced thickness includes terms 1, ½, ⅓, and ¼.

11. A vibrating body as set forth in claim 7 wherein said harmonic progression in at least one of said first and second series of areas of reduced thickness includes terms 1, ½a, ⅓a, and ¼a, where a is a constant.

12. A vibrating body for producing vibrations in the audible frequency range, said vibrating body having a non-uniform thickness;

said vibrating body having a first series of alternating areas of greater and lesser thickness, mass density, or bending stiffness;

adjacent areas of greater thickness, mass density, or bending stiffness of said first series being spaced apart from each other by a first predetermined distance which distance is the same between any selected pair of adjacent areas of greater thickness, mass density, or bending stiffness of said first series;

said vibrating body having a second series of alternating areas of greater and lesser thickness, mass density, or bending stiffness;

adjacent areas of greater thickness, mass density, or bending stiffness of said second series being spaced apart from each other by a second predetermined distance which distance is the same between any selected pair of adjacent areas of greater thickness, mass density, or bending stiffness of said second series;

said second predetermined distance being different from said first predetermined distance;

said second series of alternating areas of greater and lesser thickness, mass density, or bending stiffness being superimposed on said first series of alternating areas of greater and less thickness, mass density, or bending stiffness.

* * * * *